US010973270B2

(12) United States Patent
Marshall

(10) Patent No.: US 10,973,270 B2
(45) Date of Patent: Apr. 13, 2021

(54) CUMMERBUND WITH HIDDEN DETACHABLE STORAGE

(71) Applicant: Ruth Marshall, La Mesa, CA (US)

(72) Inventor: Ruth Marshall, La Mesa, CA (US)

( * ) Notice: Subject to any disclaimer, the term of this patent is extended or adjusted under 35 U.S.C. 154(b) by 0 days.

(21) Appl. No.: 15/714,449

(22) Filed: Sep. 25, 2017

(65) Prior Publication Data

US 2019/0090563 A1 Mar. 28, 2019

(51) Int. Cl.

| | |
|---|---|
| ***A41F 9/02*** | (2006.01) |
| ***A41D 27/20*** | (2006.01) |
| ***A45F 3/00*** | (2006.01) |
| ***A41F 9/00*** | (2006.01) |

(52) U.S. Cl.

CPC ..... *A41F 9/025* (2013.01); *A41D 27/201* (2013.01); *A41F 9/002* (2013.01); *A45F 3/005* (2013.01); *A41D 2300/32* (2013.01); *A41D 2300/322* (2013.01); *A41D 2400/48* (2013.01)

(58) Field of Classification Search

CPC ... A41F 9/025; A41D 27/201; A41D 2300/32; A41D 2300/322

USPC ..... 2/300, 338, 247, 311, 102

See application file for complete search history.

(56) References Cited

U.S. PATENT DOCUMENTS

| | | | | |
|---|---|---|---|---|
| 2,914,070 | A * | 11/1959 | Kellner | A41F 9/002 2/311 |
| 3,001,202 | A * | 9/1961 | Serrano | A41F 9/002 2/102 |
| 4,472,839 | A * | 9/1984 | Johansen | A41F 9/002 128/DIG. 15 |
| 5,215,080 | A * | 6/1993 | Thomas | A61F 7/10 607/112 |
| 5,240,156 | A * | 8/1993 | Sicotte | A41F 9/002 224/148.5 |
| 6,189,154 | B1 * | 2/2001 | Ducharme | A45C 13/02 2/247 |
| 7,828,457 | B2 * | 11/2010 | Davidoff | A45C 1/024 362/109 |
| 9,289,051 | B1 * | 3/2016 | Capps | A45F 5/02 |
| 2013/0139298 | A1 * | 6/2013 | Crump | A45F 5/00 2/247 |

* cited by examiner

*Primary Examiner* — Anna K Kinsaul
*Assistant Examiner* — F Griffin Hall
(74) *Attorney, Agent, or Firm* — Austin Tyler Cairns

(57) ABSTRACT

A dismountable pocket removably engaged within a cummerbund permitting a user to discretely store personal items therein. The dismountable pocket is removably engaged within a cavity of the cummerbund central portion utilizing a hook/loop system. A zipper is positioned on the first wall of the cummerbund body permitting access to the cavity therein. The dismountable pocket has a second zipper connecting the first and second pocket surfaces and permitting access to the storage cavity within the pocket. The cummerbund is configured to rest flat on the torso of the user while personal items are stored therein.

6 Claims, 6 Drawing Sheets

CUMMERBUND WITH HIDDEN DETACHABLE STORAGE

FIELD OF THE INVENTION

The present invention relates generally to apparel accessories, and more specifically to cummerbunds with integrated hidden storage components having a selectively removable engagement to and from.

BACKGROUND OF THE INVENTION

Cummerbunds are generally known in the art as fabric sashes worn at the waist along with formal attire such as a tuxedo in place of a vest. The cummerbund enhances the look of the tuxedo while adding a formal accessory to the traditional garment functioning solely as an ornamental element without any utility. Many tuxedo pants lack pockets to maintain the smooth appearance required in the formal setting. A wallet bulging out of a front or back pocket may be unsightly and is often discouraged. This constraint leaves many users searching for a means of storing personal essentials such as a credit card, identifications, and other small items.

U.S. Pat. No. 3,001,202 (Serrano) teaches a traditional cummerbund having an elongated main body of sufficient length to embrace the front and either side of the waist of the user. Serrano teaches a traditional cummerbund as commonly known in the arts. However, Serrano is limited in that it does not provide the storage utility of the cummerbund. The user is left without a secure means of storing personal items during use.

U.S. Pat. No. 5,802,613 (Marshall) teaches a hidden pocket for the storage of valuables in a neckwear body. While Marshall teaches the idea of a hidden pocket stored within a storage pocket, Marshall does not teach the hidden pocket to be utilized within a cummerbund which requires a sufficiently discrete manner of storing the valuable items.

It can be seen that an advancement in the arts of a cummerbund having storage utilities is desired. One such advancement is described herein.

SUMMARY

The apparatus described herein is easily manufactured from conventional fabric or other materials currently used for cummerbunds. Materials are manufactured to have a cummerbund body, defined as a central portion separated by first and second straps. Each strap has a releasable attachment means affixed to it's terminal end such that when a user positions the cummerbund around their waste, sufficient tension achieved by engaging the attachment means retains the cummerbund about the waste of the user. First and second side walls of the central portion define an interior cavity wherein a dismountable pocket may be stored. The dismountable storage pocket has a first and second pocket surface each having interior and exterior sides forming one or more storage cavities with an aperture at the top. A zipper permits the selective opening and sealing of the pocket aperture to retain personal items therein. The storage pocket is removably engaged with the cummerbund using a hook/loop system to retain the storage pocket discretely within the cummerbund during use.

BRIEF DESCRIPTION OF THE DRAWINGS

Various embodiments of the invention are disclosed in the following detailed description and accompanying drawings.

DETAILED DESCRIPTION AND PREFERRED EMBODIMENT

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured. For the purpose of clarity, the use of the term "device" refers to the invention as a whole and all of its components therein.

This written description uses examples to disclose the invention, including the best mode, and also to enable any person skilled in the art to practice embodiments of the invention, including making and using any devices or systems and performing any incorporated methods. Although an exemplary embodiment of the present invention has been shown and described, it will be apparent to those having ordinary skill in the art that a number of changes, modifications or alterations to the invention described herein may be made, none of which depart from the spirit of the present invention. All such changes, modifications, and alterations should therefore be seen as being within the scope of the present invention.

Figure 1:
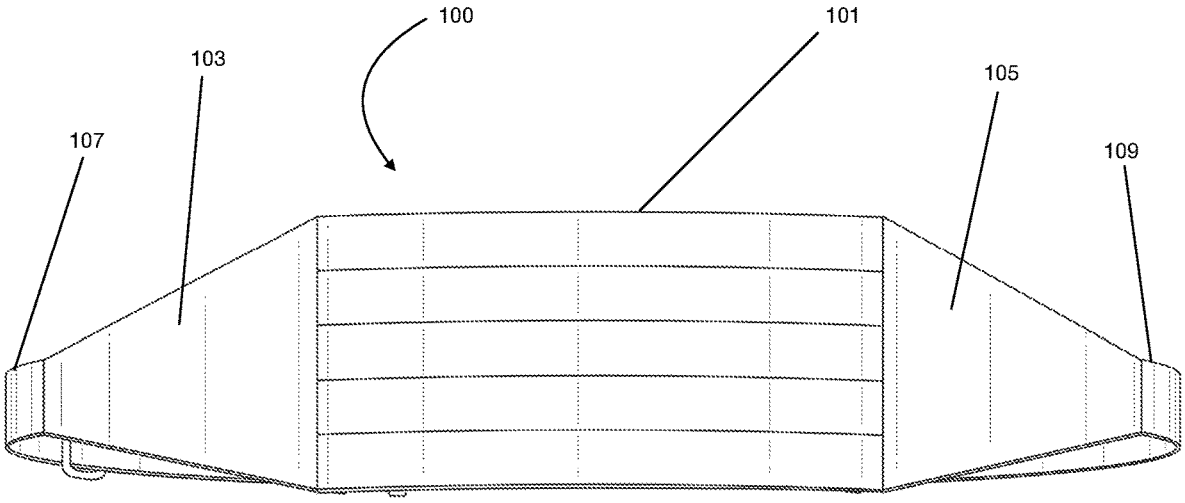
FIG. 1 illustrates a front elevation view of the device having a concealed storage component, according to an embodiment of the present invention.
Figure 2:
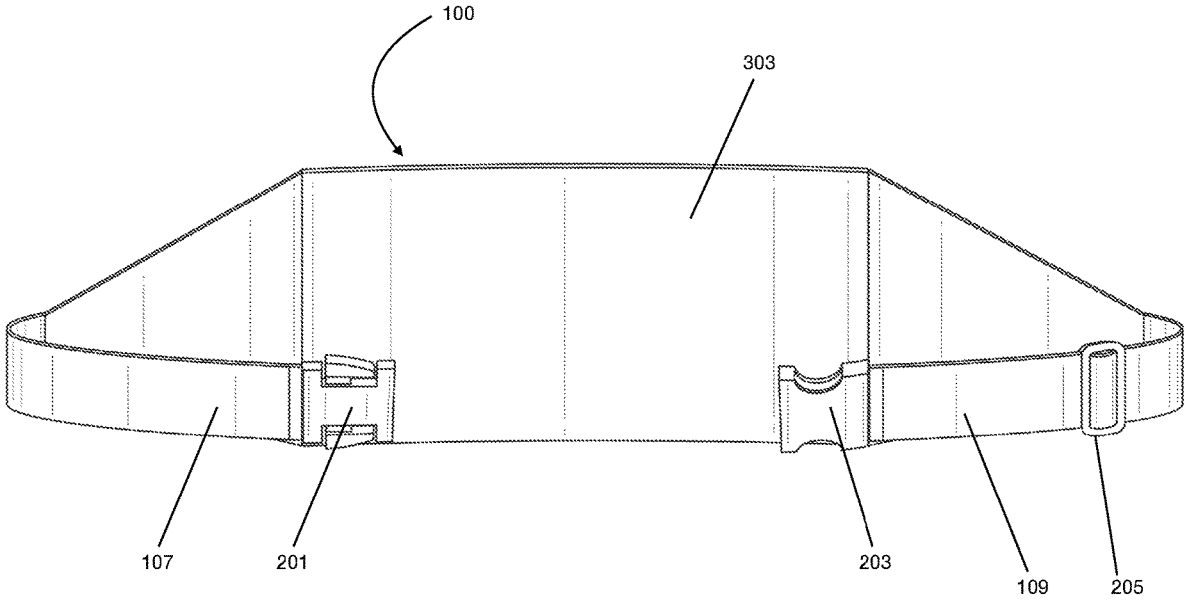
FIG. 2 illustrates a rear elevation view of the device having a concealed storage component, according to an embodiment of the present invention.

In general, a dismountable pocket is incorporated into a main body component. In the particular embodiment, the main body component is a cummerbund body, or similar piece of accessory apparel positioned about the waste of the user. In reference to FIG. 1 and FIG. 2, the cummerbund with dismountable pocket is illustrated in an embodiment of present invention. Specifically, a flat central portion 101 separates first and second tapered portions 103, 105. Each tapered portion has a greater end contacting the central portion 101 such that a height of the central portion 101 and tapered portions are substantially similar to create a smooth transition. Each lesser end of the tapered portions 103, 105 are affixed to a first and second ends 107, 109 of the cummerbund. The length of the central portion 101, each tapered portion 103, 105, and first/second ends 107,109 is sufficient to be secured around the waist of a user such that the central portion embraces the frontal torso of the user. First and second straps 107, 109 are configured to releasably engage one another by utilizing tightening means 205 such as a buckle system, clasping system, hook/loop component, or similar means. During use, the cummerbund is maintained in a circular form about the torso of the user. In an embodiment, the central portion 101 is gradually tapered in width from its medial portion to the ends thereof. In general, the central portion 101 is elongated and long enough to embrace the middle of the torso and both sides of the user while each end 107,109 contacts the back of the user on the opposing side of the central portion. In an alternate embodiment, each tapered portion 103, 105 is positioned to embrace the lateral portion of the abdomen just above the coxal region (hip).

During use, the user positions the central portion over the medial area of the torso having each end extending around the circumference of the torso. First and second ends are releasably engaged at the back of the user such that sufficient tension is placed on the cummerbund in order to maintain an appropriate position on the user.

As the user tightens the cummerbund and use is commenced, tension is applied from the straps 107, 109 to the first and second side walls of the cummerbund ensuring that the first and second side walls do not separate, and bulging from the storage pocket 309 is minimized. This ensures the cummerbund rests flat on the torso of the user to maintain the classic appearance when combined with a tuxedo or similar formal attire.

Figure 3:
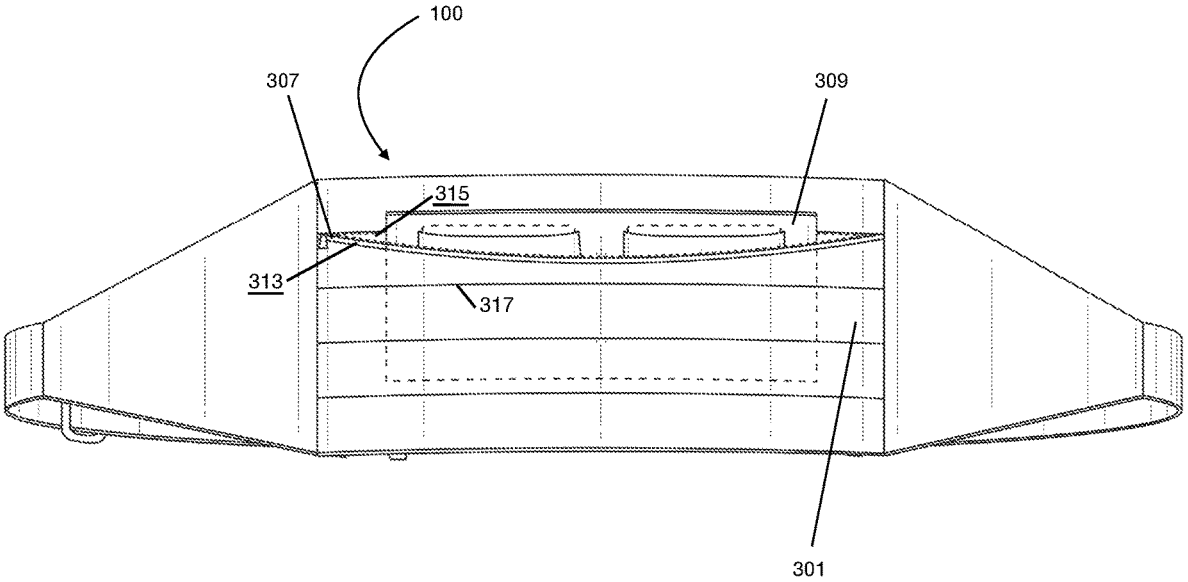
FIG. 3 illustrates a front elevation view of the device having a detachable storage component, according to an embodiment of the present invention.

Referring now to FIG. 3, the central portion 101 has a first side wall 301 and a second side wall 303 forming the central portion, wherein the first and second side walls 301, 303 are integrally connected about their perimeters to form a cavity 305 therein. A first zipper 307 is positioned along a length of the first side wall 301 such that the user may selectively open and close the cavity 305. The cavity is adapted to retain a dismountable pocket 309 assembly such that the dismountable pocket 309 may be discretely stored within the central portion 101 of the cummerbund during use.

In an embodiment, the dismountable pocket has a first and second pocket surfaces 313, 315 and each surface has an interior and exterior sides. Each of the first and second pocket surfaces 313, 315 are affixed to form a storage cavity 401. A pocket aperture is positioned on the top of the pocket having a zipper to allow the user to selectively open and seal the aperture. The pocket is formed to minimize distance between the first and second pocket surfaces to aid in the reduction of the overall thin profile of the pocket when stored within the cummerbund cavity.

In a preferred embodiment, a hook/loop 501, 503 system retains the dismountable pocket 309 to an inner surface of one of the side walls 301, 303. One skilled in the art may appreciate that either interior surface of the sidewall may be utilized. In a preferred embodiment, the second side wall interior surface is used. A hook/loop component 503 is mounted to the interior surface (not shown) of the cummerbund body 100, while a corresponding hook/loop component 501 is mounted to the exterior side 311 of the second pocket surface 315 of the dismountable pocket 309. A zipper or other conventional mounting such as a snap or combinations thereof can also be used to provide a selectively removable mounting system to removably mount the pocket to the cummerbund central body 101 depending upon the special requirements of the application. So long as the mounting hardware on the cummerbund body is positioned to align with corresponding mounting hardware on the dismountable pocket 309, the pocket 309 can be easily mounted and dismounted from multiple cummerbunds without the need to remove the contents of the dismountable pocket 309 prior to each dismount and remount of the pocket. This allows for numerous cummerbunds to be interchanged while the interchangeability of the pocket 309 is facilitated.

In an embodiment, the first and second side walls 301, 303 of the cummerbund 100 are affixed to one another such that the cummerbund rests in a flat manner on the abdomen of the user. The cummerbund is meant to rest uniformly smooth over the user without bulging areas divulging the storage therein.

The dismountable pocket 309 permits the user to carry personal items and valuables such as identification, cards, money, and similar items discretely within the central portion of the cummerbund. In order to maintain the smoothly-lined appearance of the cummerbund, which is typically worn with a tuxedo, a plurality of pocket storage cavities 401 are positioned on the external surface of the dismountable pocket 309 assembly. Each pocket cavity 401 is configured to receive personal items therein. To promote discrete carrying of the items, each pocket cavity 401 may be oriented within the central portion 101 such that the pocket cavity contacts the second interior side wall against the torso of the user. In this manner, the exterior surface of the pocket 309 which does not have pocket cavities 401 is oriented outwards with respect to the user, promoting a smooth first side wall which is visible to others. Further, the first side wall may have a ruffled, pleated, or similarly styled texture both for aesthetic appeal, and the utility of hiding the presence of personal items stored within the cummerbund.

Figure 4:
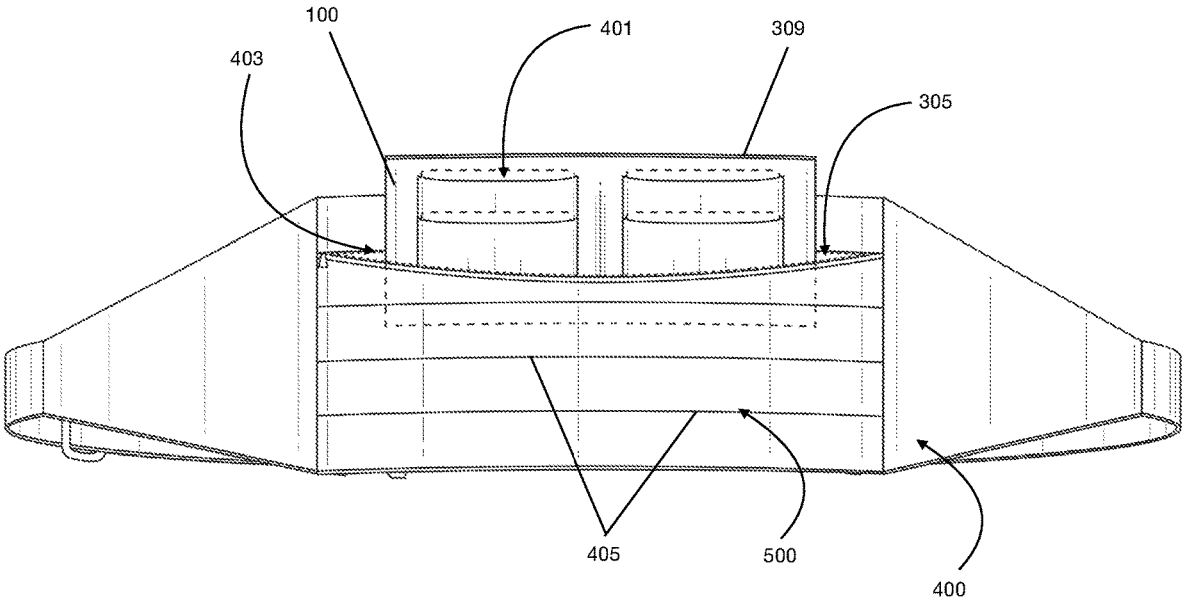
FIG. 4 illustrates a front elevation view of the device having a concealed storage component, according to an embodiment of the present invention.
Figure 5:
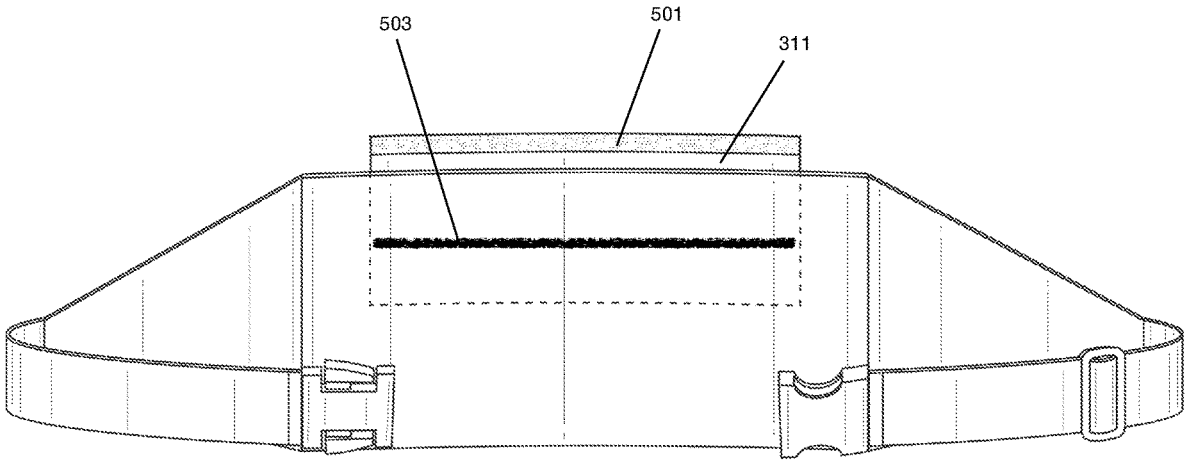
FIG. 5 illustrates a rear elevation view of the device having a detachable storage component, according to an embodiment of the present invention.

In reference to FIG. 4, the dismountable pocket 309 is shown in partially disengaged in the interior cavity 305 formed in the cummerbund between the fabric sidewalk 301, 303 inside the cummerbund central portion 101. In use, the user would mount the pocket to the cummerbund 100 using the corresponding hook/loop fastener material 501 inserting the dismountable pocket 309 through an aperture 403 allowing communication thereto from outside the cummerbund body.

Figure 6:
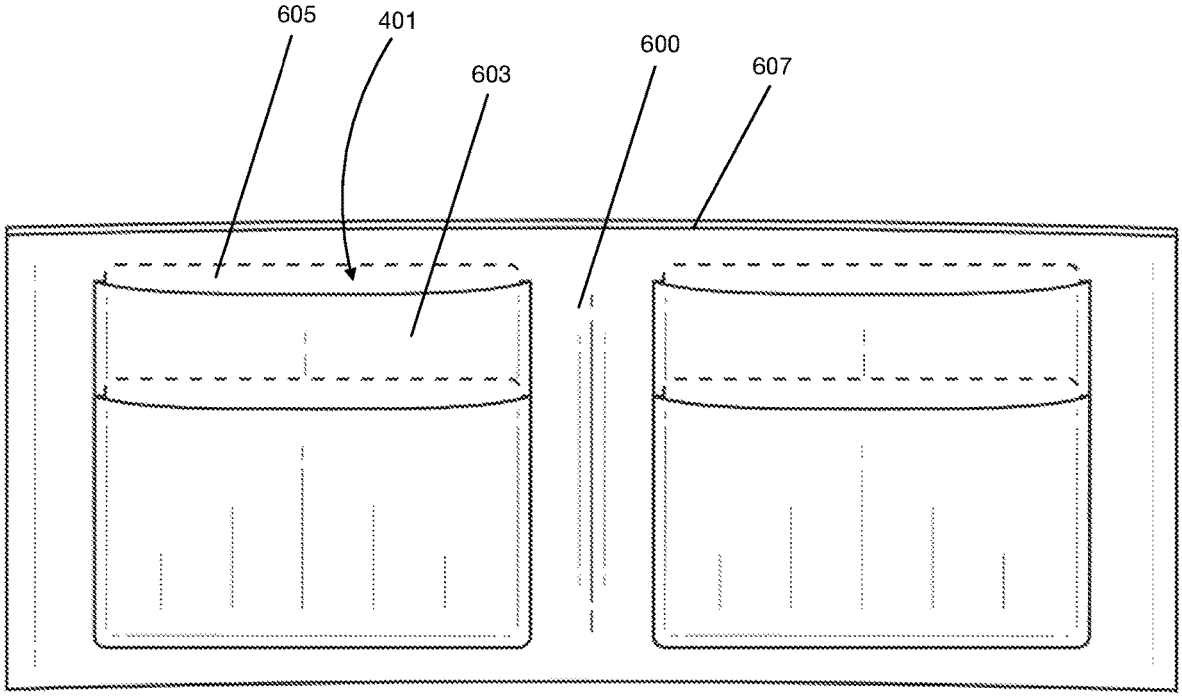
FIG. 6 illustrates a front elevation view of the storage component, according to an embodiment of the present invention.
Figure 7:
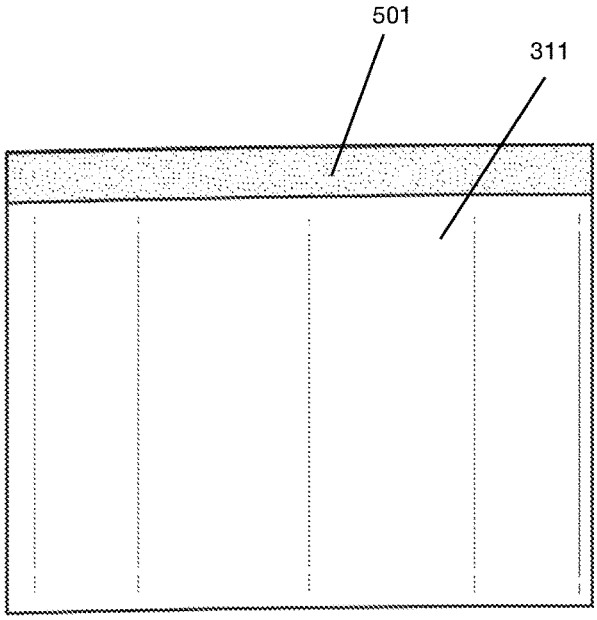
FIG. 7 illustrates a front elevation view of the storage component, according to an embodiment of the present invention.

FIG. 6 and FIG. 7 illustrate: the dismountable pocket assembly 309 isolated from the cummerbund. In an embodiment, each dismountable pocket 309 has an exterior surface 600 with pocket cavities 401 mounted thereon. Pocket cavities 401 may be formed by a pocket member 603 engaged with the exterior surface forming a pocket aperture 605 in communication with the pocket cavity 401. Secondary pocket members may be mounted to the pocket member to form additional tiered pockets. One skilled in the art may appreciate that any number of pockets may be utilized to store personal items. In an embodiment, the pocket aperture is positioned at the top of the pocket, allowing the user to easily access personal items within the cavity while wearing the cummerbund. The pocket entry aperture 605 in all embodiments may have an optional aperture sealing means such as a zipper or other fastener to keep the entry aperture selectively sealed, Optionally, a transparent wall formed from plastic or other clear material can be placed in the exterior surface of the dismountable pocket 309 to form a section to hold identification which would remain hidden on the person's body side of the cummerbund or on the aforementioned interior of the cummerbund until needed.

In an embodiment, at least one surface of the pocket may have a pleated material 317 for aesthetic purposes.

In further embodiments, pocket members for the storage of personal items may be disposed on the interior, or exterior of the pocket cavity 401 in any number of size and frequency permitting the user to quickly access items as well as discretely store the same within the cummerbund.

In a preferred embodiment, a second zipper 607 positioned between first and second pocket surfaces 313, 315 permits user to selectively open and seal the pocket entry aperture 605.

In an embodiment, each of the first and second ends 107, 109 are extendable in length to accommodate varying waste sizes of users. This may be accomplished with any hardware known in the arts including stretchable materials, or length adjustment mechanisms.

To aid in the discrete concealment of personal items within the cummerbund, the cummerbund body may be manufactured from non-traditional materials in the cummerbund arts such as a leather or other materials that have a sufficient thickness to hide the items stored within the storage pocket. Pleated material may be manufactured from silk, or similarly aesthetic materials to match the traditional appearance of the cummerbund. In a preferred embodiment, a first material 400 is used to manufacture the cummerbund body, and dismountable pocket. A second material 500, thinner and more lightweight with respect to the first material is utilized as a top visible layer for at least one sidewall of the central portion of the cummerbund, as well as at least one exterior pocket surface.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiment disclosed herein, but instead as being fully commensurate in scope with the spirit of the invention throughout the description.

What is claimed is:

1. An apparatus for the storage of personal items in a cummerbund body comprising: a storage pocket comprising: a first pocket surface having an interior side and an exterior side and having, a second pocket surface having an interior side and an exterior side, wherein the second pocket surface is affixed to the first pocket surface to form one or more storage cavities, at least one aperture positioned on a top side of the storage pocket permitting the disposal of personal items therethrough; and a first zipper releasably engaging the top side of both the first and second pocket surfaces to selectively open and close the at least one aperture; a hook/loop component affixed to the exterior side of the second pocket surface, a cummerbund body, comprising: a first strap and a second strap separated by a flat central portion sized to embrace the torso of a user, releasable attachment means on terminal ends of the first strap and the second strap, wherein the releasable engagement of the attachment means imparts tension on the cummerbund body retaining the cummerbund around the torso of a user; a first side wall and a second side wall defining the flat central portion, the first and second side wall forming an interior cavity of the cummerbund body therebetween, having a second zipper permitting the user to open and seal the cavity, having a corresponding hook/loop component disposed within the interior cavity of the flat cummerbund body, wherein the corresponding hook/loop component is positioned on an interior surface of the second side wall to releasably engage with the hook/loop component on the storage pocket, wherein the interior cavity is dimensioned to accommodate the removably engaged storage pocket therein to conceal the storage pocket from view when worn by the user, wherein the cummerbund body and the storage pocket are constructed of a first material, wherein a second material is utilized as a visible layer, and wherein the second material is more thin than the first material.

2. The apparatus of claim 1, further comprising a pleated material on the first side wall of the central portion, wherein the pleated material is on an exterior surface of the first side wall, and wherein the pleated material hides the presence of the storage pocket.

3. The apparatus of claim 2, further comprising a pleated material on the first pocket surface to hide the presence of items within the storage pocket.

4. The apparatus of claim 3, wherein the releasable engagement means comprises adjustable buckle components mounted to the terminal ends of the straps to permit the user to adjust the size of the first strap and the second strap to embrace the torso of the user.

5. The apparatus of claim 4, wherein the releasable engagement means comprises a combination of fastener components mounted to the terminal ends of the straps.

6. The apparatus of claim 5, having first and second tapered portions mounted between the central portion and the first strap and the second strap.

* * * * *